United States Patent [19]

Wilson

[11] Patent Number: 4,510,725

[45] Date of Patent: Apr. 16, 1985

[54] BUILDING BLOCK AND CONSTRUCTION SYSTEM

[76] Inventor: Mark E. Wilson, 2314 Kingston Dr., Houston, Tex. 77019

[21] Appl. No.: 303,179

[22] Filed: Sep. 17, 1981

[51] Int. Cl.[3] ..... E04C 1/10

[52] U.S. Cl. ..... 52/309.1; 52/593; 52/606; 52/101

[58] Field of Search ..... 52/593, 594, 595, 596, 52/589, 591, 606, 602, 415, 101, 232, 515, 309.13; 428/326, 907, 921

[56] References Cited

U.S. PATENT DOCUMENTS

| | | | |
|---|---|---|---|
| 347,392 | 8/1886 | Smith | 52/198 |
| 513,423 | 1/1894 | Schmall | 52/606 |
| 888,399 | 5/1908 | Hengerer | 52/606 |
| 1,080,367 | 12/1913 | Raftis | 52/450 |
| 1,477,258 | 12/1923 | Gilbert | 52/606 |
| 1,686,373 | 10/1928 | Foster | 52/606 |
| 1,921,518 | 8/1933 | Frobisher | 52/606 |
| 2,023,023 | 12/1935 | Kaufman | 52/606 |
| 2,296,002 | 9/1942 | Tym | 52/606 |
| 2,649,034 | 8/1953 | Gramelspacher | 428/146 |
| 3,857,934 | 12/1974 | Bernstein et al. | 52/101 |
| 3,915,777 | 10/1975 | Kaplan | 52/515 |
| 4,112,162 | 9/1978 | Casselbrandt | 428/326 |
| 4,220,688 | 9/1980 | Mitchell et al. | 428/907 |
| 4,241,133 | 12/1980 | Lund et al. | 428/326 |

FOREIGN PATENT DOCUMENTS

| | | | |
|---|---|---|---|
| 976322 | 10/1975 | Canada | 52/309.1 |
| 802951 | 7/1949 | Fed. Rep. of Germany | 52/606 |
| 512239 | 1/1921 | France | 52/593 |
| 2453959 | 12/1980 | France | 52/593 |
| 224314 | 5/1930 | Italy | 52/606 |
| 312925 | 4/1956 | Switzerland | 52/606 |
| 461066 | 10/1968 | Switzerland | 52/596 |
| 434127 | 8/1935 | United Kingdom | 52/606 |
| 1190816 | 5/1967 | United Kingdom | 428/326 |

*Primary Examiner*—Henry E. Raduazo

*Attorney, Agent, or Firm*—Cooper, Dunham, Clark, Griffin & Moran

[57] ABSTRACT

A rectangular building block is formed from a composition of wood fiber and a thermoplastic or thermosetting resin. The block comprises an outer shell and a web defining a plurality of hexagonal cross-sectional openings forming a honeycomb cell within the shell. The blocks may be interlocked and arranged to form a structure.

9 Claims, 5 Drawing Figures

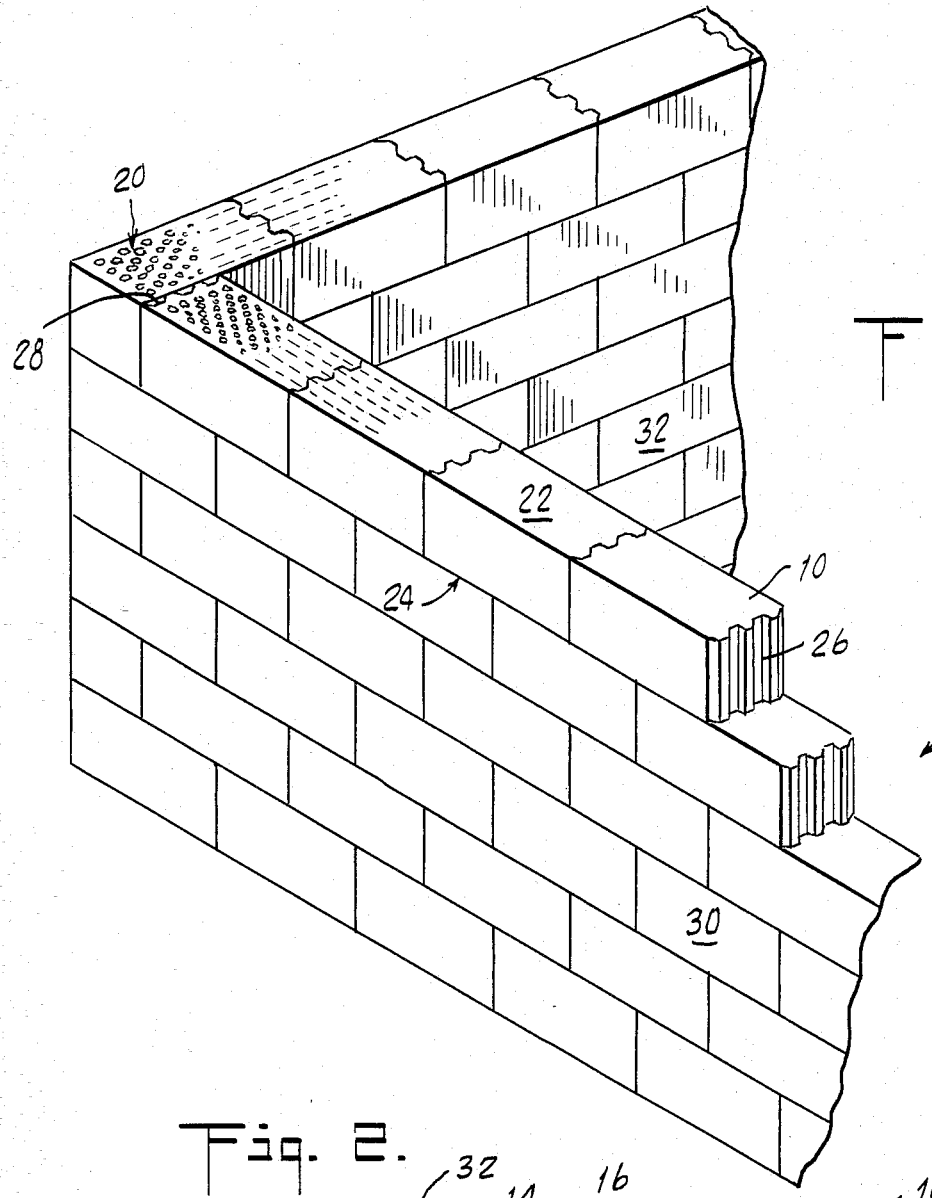
Fig. 1.
Fig. 2.
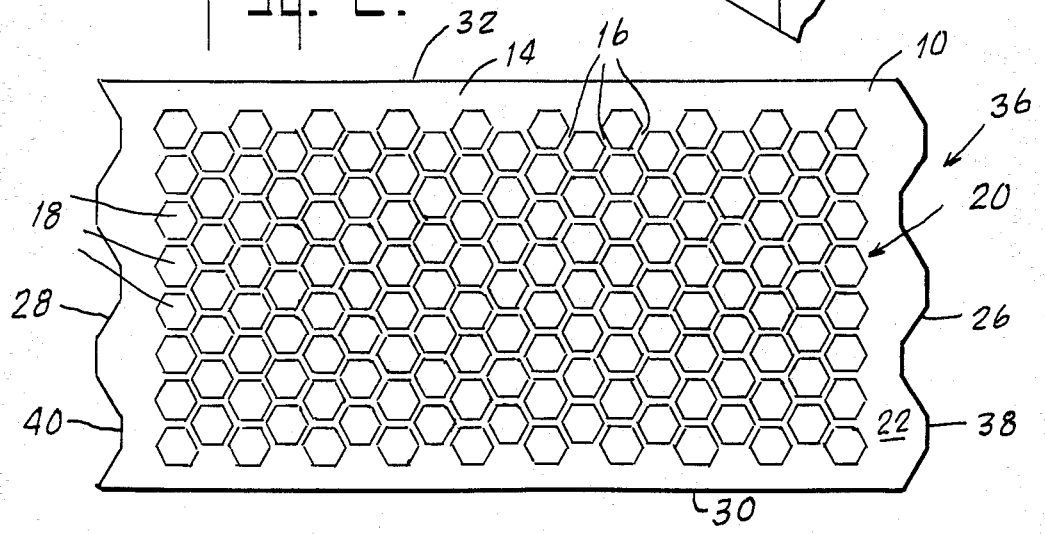

BUILDING BLOCK AND CONSTRUCTION SYSTEM

BACKGROUND OF THE INVENTION

The present invention relates to a novel building block and a system of construction which employs the building block. More particularly, the invention relates to a rectangular building block formed from a composition of wood fiber and a thermoplastic or thermosetting resin. The construction system employs an array of such blocks adapted to interlock to form a structure.

It has long been known that rectangular solid blocks are useful in building a structure. Typically, structures are built from bricks, cinder or concrete blocks, or tiles. These building materials themselves are inexpensive, but they are heavy, do not provide much insulation, are expensive to transport and to fabricate and are prone to breakage.

Accordingly, it has long been desired to reduce the weight of building materials, to make them more readily transportable, and easier to handle. To some extent, this has been accomplished by forming the materials with interior openings. For example, U.S. Pat. Nos. 1,080,367; 1,477,258; and 2,023,023 show various building blocks are made of brick, ceramic material, clay or terra cotta which have openings therethrough. But, these structural components continue to have substantial weight, are readily broken and have little insulation value. In addition, some may require unusual construction technique which typically results in opposition from the building traces and local building inspectors. See, for example, U.S. Pat. Nos. 347,392 and 513,423.

It is also known to use building materials which are not as heavy, such as those made from artificial wood or wood pulp. However, these building materials lack columnar strength, are prone to breakage and are difficult and expensive to fabricate. See, for example U.S. Pat. Nos. 888,399 and 1,921,518.

SUMMARY OF THE INVENTION

It is a primary object of this invention to provide a building block which may be inexpensively and easily formed from a wood and resin composition.

It is another object of the invention to provide a rectangular building block which is light-weight, has high insulation value, and is easily transportable and utilized.

It is still another object of the invention to provide a building block which when arranged in a structure produces planar exterior and interior walls.

It is still another object to provide a construction system using the building blocks of the invention.

The present invention contemplates a substantially rectangular building block formed from a composition of wood fiber and a thermoplastic or thermosetting resin. The block includes a shell and a centrally disposed web containing a plurality of elongated openings having a hexagonal cross-section. These openings extend between upper and lower bearing faces of the block. The openings are arranged to form a honeycomb cell. This permits the block to be light-weight and still have good columnar strength. The blocks have interlock means on the side faces so that the blocks may engage and mate with horizontally adjacent blocks of the same course, thus giving good lateral strength. The exterior and interior faces of the block are planar and may be decorated.

The system of the present invention contemplates the interconnection of a plurality of such building blocks to form a structure. The blocks may be arranged in any of the familiar patterns used in construction, for example, American bond, English bond, or Flemish bond, depending upon the size of the blocks and the decorative effect desired. When the blocks are assembled into an array, the structure has load-bearing strength nearly equivalent to that of a brick wall of conventional construction and lateral strength which may exceed that of a brick wall because of the interlocking blocks. However, the blocks do not weigh as much as cinder blocks. Thus, the blocks are easier to handle, less expensive to transport, and easier to construct. On the other hand, the blocks are not so unusual in form and shape as to provoke resistance on the part of construction workers or building inspectors.

DESCRIPTION OF THE DRAWINGS

FIG. 1 is a perspective view of an array of blocks assembled into a structure in accordance with the system of the invention.

FIG. 2 is a plan view of a building block made in accordance with the invention.

DETAILED DESCRIPTION OF THE INVENTION

Figure 3:
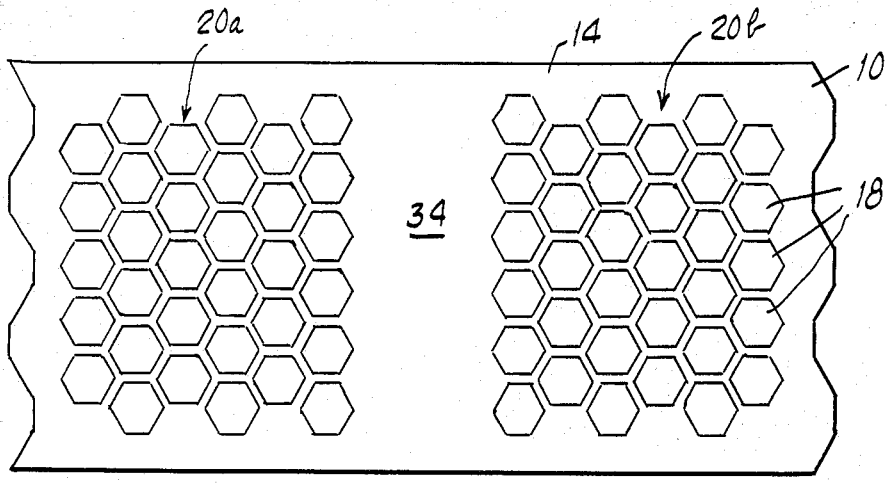
FIG. 3 is a plan view of another embodiment of a building block.

Generally, a shown in FIG. 1 of the drawings, the present invention relates to a rectangular building block 10 formed from a composition of wood fiber and a thermoplastic or thermosetting resin. An array of blocks 12 is assembled to form a structure.

Each block 10 comprises an shell 14, a web 16 disposed centrally of the shell 14, and a plurality of elongated openings 18 defined by the web 16. A series of openings 18 define a honeycomb cell 20.

Each block 10 preferably is formed of wood particles bonded with a resin. This material is much less heavy than conventional block materials. Indeed, blocks 10 do not weigh as much as a cinder block of the same size. The desired composition for making blocks 10 is similar to that commonly used in making particles ranging in size from nearly saw dust to large flakes, which particles are adapted to be pressed or extruded into blocks. Powdered resins now available and commonly used in the wood products industry are suitable to bind the wood particles. The wood particles are relatively inexpensive because they are the by-products and residue of wood processing.

As in conventional building blocks, the blocks 10 are parallelepiped in form and have six faces or sides: upper and lower faces 22 and 24, which are load-bearing; side faces 26 and 28, which engage horizontally adjacent blocks; and planar faces 30 and 32, which form the exterior and interior surfaces of a structure formed by an array of blocks 12. The blocks 10 may be of any suitable size, but preferably are 16″×8″×8″, which is the industry standard size for cinder or concrete blocks. As is well known in the industry, such a block is actually $15\frac{3}{4}''\times7\frac{3}{4}''\times7\frac{3}{4}''$. It is possible for the blocks 10 to be larger or smaller in size, but an odd size may be more difficult to use in a conventional construction method. Blocks 10 may easily be cut to size, however.

Blocks 10 may be used for load-bearing applications, for divider or curtain walls, or as beams. However, such blocks are particularly advantageous in building a structure where light weight and ease of construction are the primary goals. Blocks 10 have at least the following advantages over bricks, cinder blocks, concrete blocks, and the like:

(a) blocks 10 have greater insulation value than do blocks made of more conventional materials. This permits the elimination or reduction of batt insulation, at least in temperate climates;

(b) blocks 10 may eliminate the need for interior wood framing. Dry wall, panelling, or other surface materials may be nailed or adhered directly to the array of blocks 12;

(c) because of their light weight, blocks 10 are easier to handle on site and less expensive to transport to a construction site;

(d) blocks 10 have a greater load-bearing capacity per unit of weight than do blocks made of conventional materials;

(e) blocks 10 are rigid, but are sufficiently flexible so as not to break as readily as those made of conventional materials;

(f) electrical wiring may be easily installed within blocks 10 by threading through the openings 18, without marring the external appearance of the block; and (g) blocks 10 may be installed more rapidly than typical masonry construction.

As best seen in FIG. 2, each block 10 has a plurality of openings 18 with their longitudinal axes arranged in parallel and extending between the upper and lower bearing faces 23 and 24. Similarly, the web 16 which defines the openings extends between the upper and lower bearing faces 22 and 24. The openings 18 preferably are staggered in the horizontal plane. Each of the openings 18 desirably has an hexagonal cross-section. It is believed that the hexagonal cross-sectional shape permits the greatest amount of loading per unit weight and requires the least amount of wood-like material in the block 10. It has been found, by way of example, that in a conventional-size block 10, hexagonal openings of about $\frac{3}{4}''$ diameter (side-to-side of the hexagon) and about $\frac{7}{8}''$ diameter (corner-to-corner of the hexagon), with about 1" center-to-center distance between openings, provides a maximum amount of strength per unit weight for a typical design application. This specific arrangement leaves a web about $\frac{1}{4}''$ wide between the openings.

The hexagonal openings 18 comprising the honeycomb cell 20 may be arranged according to any of several configurations. As shown in FIG. 2, the openings 18 are arranged so that the honeycomb cell 20 extends throughout nearly the entire block and the shell 14 has a relatively small horizontal dimension about $\frac{5}{8}''$–1" wide.

As shown in the modification of FIG. 3, there are two honeycomb cells 20*a* and 20*b* separated by a margin 34. The block 10 may be divided at the margin 34, for use in those applications where half-sized blocks are necessary, for example, at the corners of a structure. As the block 10 is fabricated from a wood-like material, it may be divided by use of a hand or electric saw. In FIG. 3, the openings 18 are arranged such that two sides of each hexagon are parallel to the planar faces 30 and 32 of the block.

Figure 4:
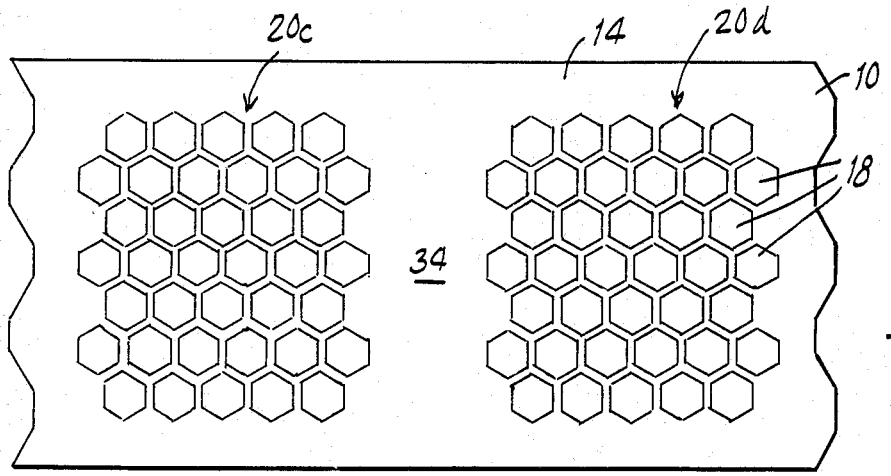
FIG. 4 is a plan view of still another embodiment of a building block.

In FIG. 4, there is shown another modification of the honeycomb cells. In this arrangement, there are two cells 20*c* and 20*d* separated by a margin 34. The openings 18 are arranged such that no sides of the hexagons are parallel to the planar faces 30 and 32. Rather, two corners of each hexagon point toward the planar faces 30 and 32. It is believed that either the configuration of FIG. 3 or of FIG. 4 will give the same columnar strength and that the choice of configuration depends upon the lateral force which may be encountered in the specific application.

The engaging or side faces 26 and 28 of the blocks 10 are provided with interlock means 36. Interlock means 36 permit horizontally adjacent building blocks in the same course to mate. One engaging face, for example, face 26, is provided with a plurality of keys 38 while the other engaging force, for example face 28, is provided with a corresponding plurality of keyways 40. Keys 38 of face 26 are adapted to interlock with keyways 40 of face 28 of the horizontally adjacent block. The interlock prevents horizontal movement between blocks in the same course.

As the exterior and interior faces 30 and 32 are planar, they either may be readily decorated or used as is without decoration. The planar faces 30 and 32 also may be provided with a fire-retardant coating, if necessary to meet local building code or insurance specifications. They also may be provided with a veneer or other suitable finish. It is desirable to impregnate the blocks 10 with a pesticide and/or fungicide.

When the blocks 10 are formed into an array 12, they commonly are arranged in an offset pattern as shown in FIG. 1. As the bearing faces 22 and 24 are flat, the blocks may be built up in courses to form the array. In this arrangement, at least some of the openings 18 in each block 10 register with corresponding openings in vertically adjacent blocks. Electrical wiring then may be readily installed in the structures by snaking through the registered openings. Normally, the blocks 10 in each course are secured by fastening means, such as an adhesive, to the blocks in vertically adjacent courses. Any adhesive now available and commonly used in the wood products industry is suitable to secure the courses. It further is desirable to adhesively secure the blocks in the same course at the interlock 36.

Figure 5:
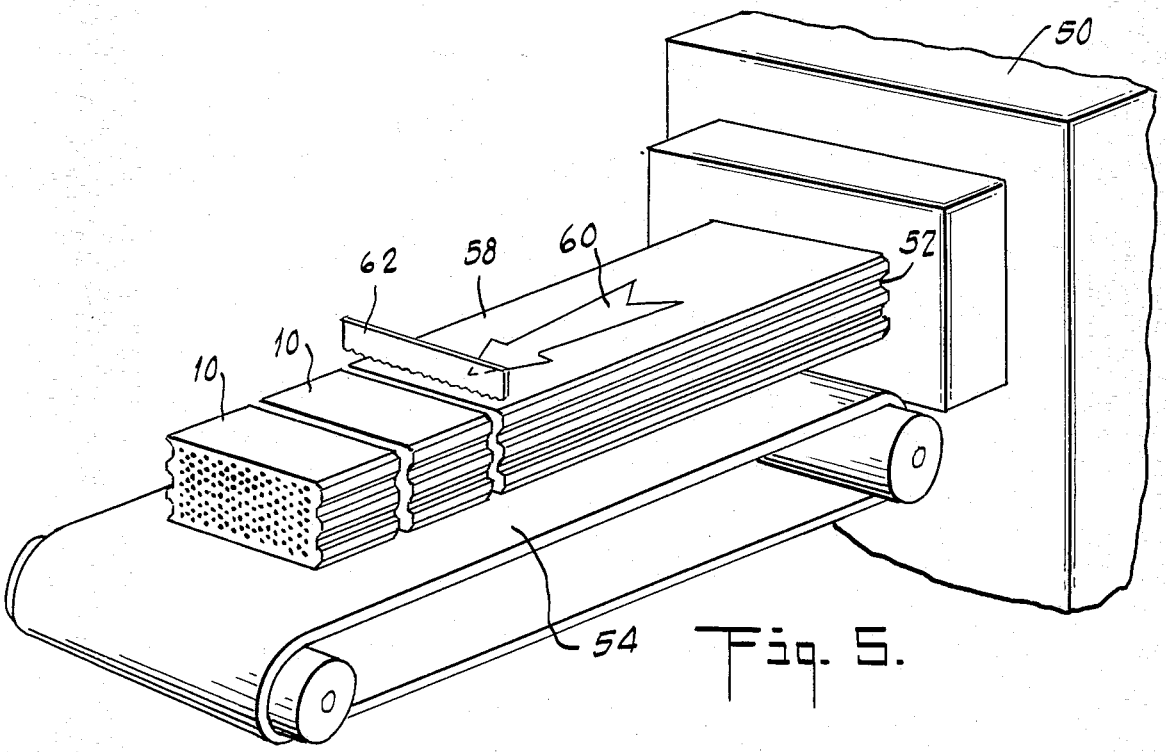
FIG. 5 is a perspective view of method and apparatus for forming the blocks used in the present invention.

A preferred apparatus and method for forming the building blocks used in the invention is shown in FIG. 5. The wood pulp and resin are placed in any conventional extruder 50 and extruded through a die 52 onto a conveyor 54. The die 52 is configured so as to extrude a continuous column 58 of the desired cross-section in the direction of the arrow 60. A cutting element 62 separates the column 58 into blocks 10 at desired intervals. By the time that a block 10 has travelled to the end of the conveyor 54, it has cooled and formed into the correct shape.

It also is contemplated that the blocks 10 be cut on the conveyor 54 such that the bearing faces 22 and 24 are provided with interlock means 36 of the type provided on the side engaging faces 26 and 28. This permits the bearing faces 22 and 24 to mate and interlock with the bearing faces of blocks in vertically adjacent courses. Such mating further prevents horizontal movement in the structure.

The detailed description is intended to be illustrative of building blocks, and a system of construction using such building blocks, in accordance with the invention. The building blocks shown in FIGS. 2, 3, and 4 are the preferred embodiments. Nevertheless, it should be appreciated that various modifications could be made in building blocks 10 which remain within the spirit and the scope of the invention. Many other uses of the building blocks 10 will be apparent to those working in the construction and other industries.

What is claimed is:

1. A substantially rectangular building block formed from a composition of wood fiber and a resin, comprising:

(a) a solid shell having first and second bearing faces;

(b) a web disposed centrally of the shell and extending between the first and second bearing faces;

(c) a plurality of elongated openings defined by the web, the openings each having a substantially hexagonal cross-section and having their longitudinal axes arranged in parallel and terminating at the first and second bearing faces;

(d) said shell having first and second engaging faces adapted to mate with second and first engaging faces, respectively, of horizontally adjacent building blocks in an array of blocks; and (e) said first and second engaging faces having solid keys extending therefrom.

2. A building block as defined in claim 1, wherein said openings are arranged to form a honeycomb cell.

3. A building block as defined in claim 2, further comprising at least two honeycomb cells and a margin separating the cells, the block being adapted for separation of the cells at the margin.

4. A building block as defined in any of claims 1 or 2, wherein at least some of said openings are adapted to register with corresponding openings of vertically adjacent building blocks in an array of blocks.

5. A building block as defined in claim 1, wherein said shell has first and second planar faces adapted to be decorated.

6. A building block as defined in claim 1, wherein the block has a fire-retardant coating.

7. A building block as defined in claim 1, wherein the block is impregnated with a pesticide and/or fungicide.

8. A system of construction, comprising:

(a) producing a plurality of building blocks to form an array of blocks, each of said blocks comprising a solid shell, a web within the shell, said web consisting of an array of substantially equal-size, hexagonal-shape openings forming a honeycomb-like array and defining a plurality of elongated openings, the openings having their longitudinal axes arranged in parallel with each other and with first and second engaging faces, the openings terminating at first and second bearing faces, and the first and second engaging faces having solid keys extending therefrom;

(b) arranging the openings in each block so that at least some of the openings are in register with corresponding openings in vertically adjacent blocks of the array and the openings are in parallel within horizontally adjacent blocks of the array;

(c) arranging at least some of the blocks such that the keys of the first engaging face of one block mate with the keys of the second engaging face of a horizontally adjacent block of the array and the keys of the second engaging face of said one block mate with the keys of the first engaging face of another horizontally adjacent block of the array, such that the blocks of the array interlock; and (d) securing nearly every block to vertically and horizontally adjacent blocks of the array to form a structure.

9. A system as defined in claim 8, further comprising extruding the building blocks from a composition of wood fiber and a resin.

* * * * *